United States Patent [19]

Dean

[11] Patent Number: 4,776,385

[45] Date of Patent: Oct. 11, 1988

[54] AIR VENTILATION CONTROL SYSTEM

[76] Inventor: Arthur C. Dean, 13403 Vimy Ridge Rd., Alexander, Ark. 72002

[21] Appl. No.: 63,429

[22] Filed: Jun. 18, 1987

Related U.S. Application Data

[63] Continuation-in-part of Ser. No. 819,364, Jan. 15, 1985, abandoned.

[51] Int. Cl.[4] ..... F25B 29/00

[52] U.S. Cl. ..... 165/16; 98/33.1; 236/49

[58] Field of Search ..... 165/22, 16; 236/49 D, 236/49 R; 98/39.1, 42.02, 88.1

[56] References Cited

U.S. PATENT DOCUMENTS 4,023,947 5/1977 Ferry ..... 62/332 X 4,491,061 1/1985 Nishizawa et al. ..... 165/16 X 4,676,073 6/1987 Lawrence ..... 165/16 X

*Primary Examiner*—William E. Wayner

*Attorney, Agent, or Firm*—Richard C. Litman

[57] ABSTRACT

The present invention relates to those devices for enabling and disabling heating and cooling equipment and providing supplemental ventilation to an enclosure. An air intake unit is ducted to a central heating and cooling installation. The intake fan unit has an outside temperature thermostat associated therewith and which is wired to a control circuit that also monitors temperature in proximity to a thermostat-equipped exhaust fan unit located in an attic or upper crawl space. Sensing devices are used in association with the plurality of thermostats to selectively enable or disable the heating and cooling equipment and to actuate the intake and exhaust fan units, thereby providing ventilation.

4 Claims, 3 Drawing Sheets

AIR VENTILATION CONTROL SYSTEM

This application is a continuation-in-part of application Ser. No. 819,364, filed Jan. 10, 1985, now abandoned.

BACKGROUND TO THE INVENTION

Millions of homes and office buildings in the United States and elsewhere have 'dedicated' heating and cooling systems in that a centrally located thermostat actuates the respective modes of air-conditioning or heating when conditions dictate. These systems, especially in major office complexes, rely almost exclusively on such installed heating and air-conditioning systems to maintain an adequate comfort zone within the environmental spaces of the enclosures.

In many office buildings, for example, even the windows do not open to provide needed ventilation. As a result of this dependence on the mechanical heating and air-conditioning, energy costs can be excessive and equipment, through an almost constant seasonal use, wears out sooner than would otherwise be the case if a supplemental ventilation and control system were installed.

The present invention relates to those devices for enabling and disabling heating and cooling equipment for the purpose of more efficiently ventilating an enclosure and further relates to an apparatus for manually or automatically selectively switching from one mode of operation, one type of ventilation, heating or cooling equipment, to another depending on the specific prevailing environmental factors.

This invention further relates to those control systems utilizing a set of sensors, such as thermostats and humidistats or enthalpy sensors, which in conjunction with such appurtances as supply and exhaust fans, operate through the heating and cooling duct system to selectively ventilate air through an enclosure.

Specifically, this invention relates to a control system that operates in conjunction with and controls a standard ducted heating and cooling installation such that air is circulated throughout the enclosure when proper parameters of temperature and humidity are met, and which are dependent upon the existing outside ambient conditions.

SUMMARY OF THE INVENTION

The primary objective of the present invention is to provide a control apparatus for the selective enablement and disablement of heating and cooling equipment and the selective actuation of a set of supply and exhaust fans that are integral to the ducted conduits of the heating and cooling mechanical system so as to affect a more economical operation.

Another objective of the present apparatus is to provide a means whereby outside and inside temperatures and conditions of humidity are measured by thermostats and humidistats with the result that various components of the heating and cooling mechanical system are actuated or disabled to allow ventilation fans to circulate air through the conduits of the mechanical system.

A further objective of the apparatus is to provide for both automatic and manual modes of system operation that are consistent with the prevailing environmental conditions of temperature and humidity.

Another objective of the present invention is to provide a system for the selective exhausting of over-heated enclosure air into an attic or crawl space in a residential application with a subsequent expelling of this spent or over-heated air to the outside.

A still further objective of the invention is to provide a system for the selective influx of outside air for the subsequent ventilation and circulation through conduits of the mechanical heating and air-conditioning system.

DESCRIPTION OF PRIOR ART

Various devices have been patented to allow the ventilation of air in conjunction with an existing mechanical A.H.U. or ducted system. The following are found to be examplary of the prior U.S. art:

| U.S. Pat. No. | Inventor |
|---|---|
| 2,188,566 | Cowdery-Dale |
| 2,564,215 | Slane |
| 3,946,575 | Barr et al |

These patents disclose and teach various devices for the co-operative ventilation of air with a mechanical heating and air conditioning system, but none singularly or in any combination, are seen to provide improvements as offered by the apparatus of the present invention.

DESCRIPTION OF THE PREFERRED EMBODIMENT

Figure 1:
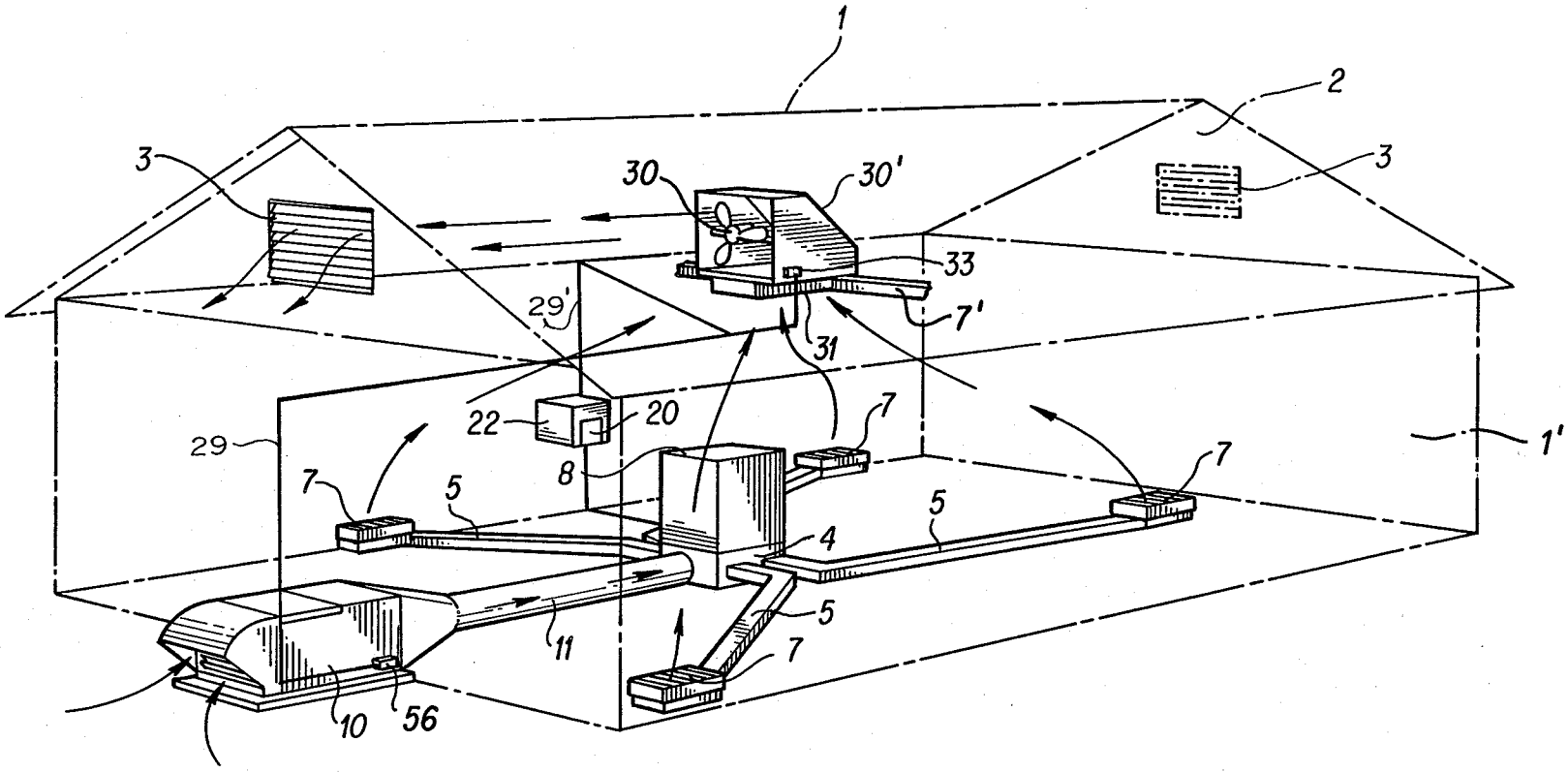
FIG. 1 is a perspective view of a typical residential enclosure provided with a mechanical heating system and shows a fresh air intake mounted outside the building with an exhaust ventilation unit also integral with the duct system.
Figure 2:
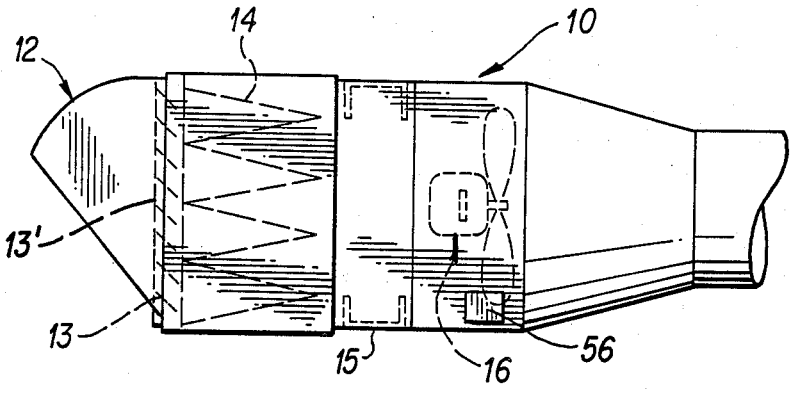
FIG. 2 is an elevational view of an outside air intake device showing major components therein in broken lines.
Figure 3:
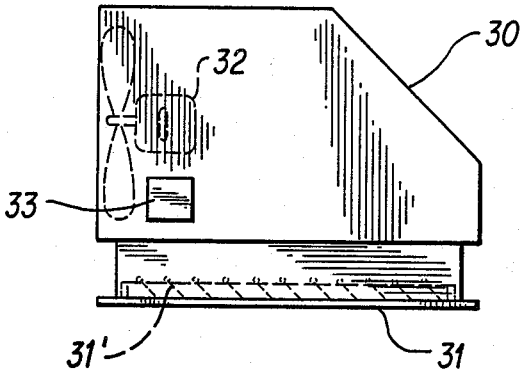
FIG. 3 is an elevational view of a exhaust device indicating major internal components in broken lines.

Referring now to FIGS. 1–4 of the drawings, an enclosure 1 has installed within it a mechanical heating system as represented by ducts 5, registers 7 and a plenum 4.

An air intake and filter unit 10 is located outdoors and connected by intake duct 11 to the central heating system ductwork by means of the plenum 4. The air intake and filter unit 10 consists of a housing enclosure for a supply fan 16 and contains a filter mechanism, such as a bag type filter 14, together with and intermediate electrostatic air cleaning mechanism 15. A protective hood 12 about the intake 20 of the housing 10 is downwardly directed and shields a louvered grid 13 extending across the intake 13'.

The louvered grid 13 may be opened or closed and acts in conjunction with filter 14 to screen out insects, and other small particles undesirable in the building or enclosure.

An air exhaust fan 30 is enclosed in a housing 30' situated in the attic 2 of the enclosure adjacent the lower living space 1' and includes a louvered duct 31 communicating with the interior space 1'. When the louvers 31 are in the open position, the fan 30 draws air directly from the space 1' below, into the attic or crawl space 2. Through a selective operation as hereinafter described and disclosed, the fan 30 will exhaust or pull heated or humid air out of the enclosure area 1' and direct it through louvers 3 in the attic 2 to the outside. Alternatively or co-operatively, fan 10 may be actuated to bring fresh air into the enclosure, the air being distributed first through intermediate duct 11, through plenum 4 and thence to registers 7 via ducts 5. As air is distributed through registers 7, which are preferably floor mounted, the air is circulated throughout the enclosure confines 1'. A mechanical assist is given this circulation in that fan 30 can be actuated to draw air directly up through louvered duct 31.

The co-operative arrangement of the components is accomplished by a control system in which an external sensor 56 is located in a protective housing outside the building or enclosure while an interior sensor 54 is located within the living space 1'. Both sensors 56 and 54 include thermostats such that both the ambient outdoor as well as the indoor temperatures may be measured by these instruments.

Figure 4:
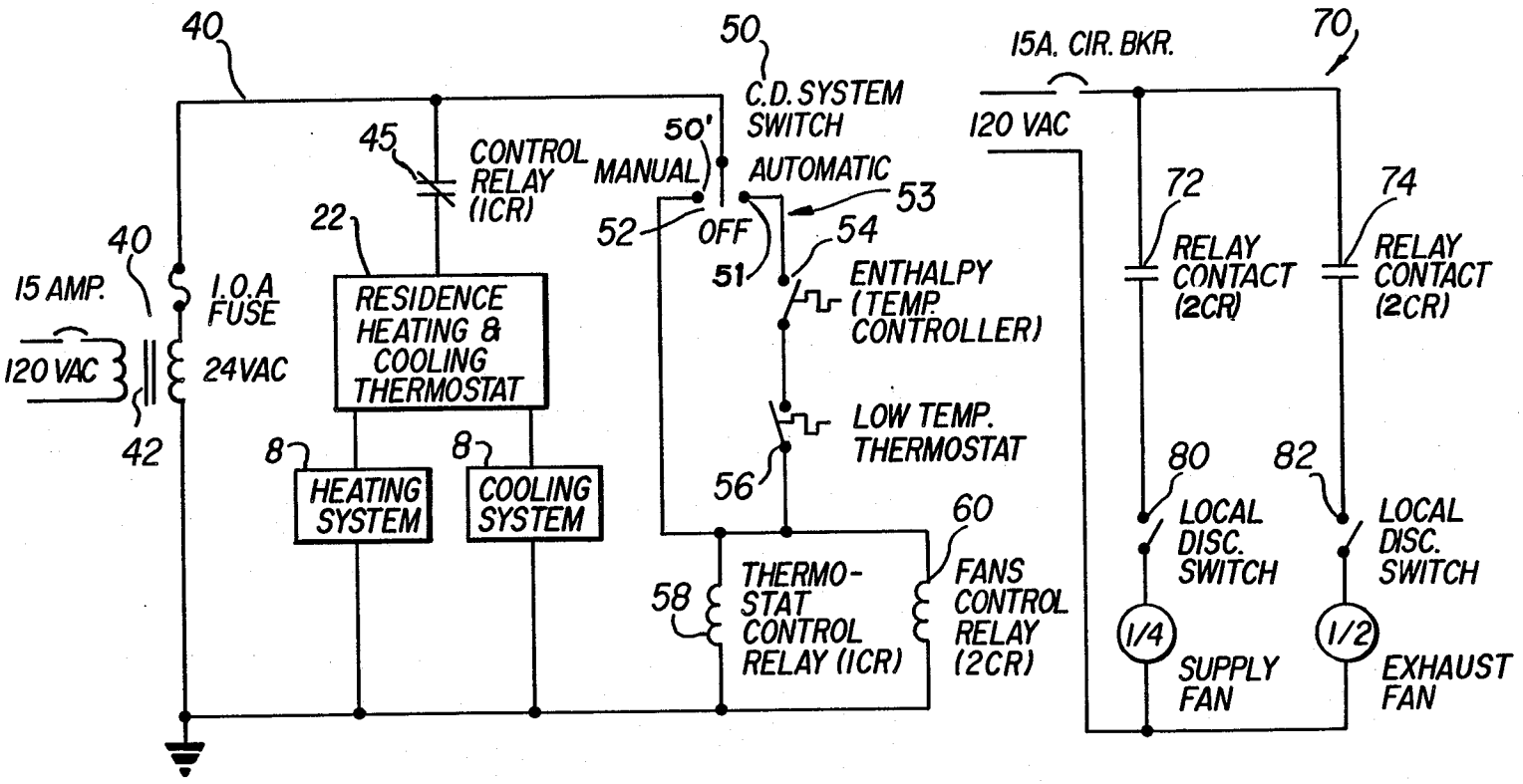
FIG. 4 is a system control schematic view indicating the functional relationships between various components of the system.

Thermostats serving as sensor instruments are contained in a control system circuit. FIG. 4 illustrates a preferred arrangement of a control circuit for the apparatus in which an input A.C. voltage 40 is reduced in voltage by step-down transformer 42 to 24 v.a.c.

Thermostatic control relays such as 58 are constructed of one normally open contact and one normally closed contact, 24 vac coil. A typical such device is manufactured by Potter-Brumfield as model No. KRPAllAY.

A fan control relay 60, constructed of two normally open contacts and rated 15 amp 24 vac, is disposed within the control circuit after the relay 58.

When a manually controlled switch 50 is positioned to a manual mode of operation (switch position 50' in FIG. 4), the exhaust fan 30 and intake fan 16 are set to run continuously until such time as the switch position is changed, or the power fails. When switch 50 is in the off position 52, the normal heating and cooling system 8 is enabled and operates under the actuation of a thermostat 22 mounted within the enclosure area 1'.

In the automatic mode, that is, when switch 50 is set to the automatic position 51, a thermostat sensor 56, residing outside the enclosure, is activated into a sub-circuit 53, such that as the temperature outside reaches or exceeds 62 degrees F., the temperature controller switch 54 closes and the circuit actuates both the intake fan unit 10 and exhaust fan unit 30. These units will then remain on until the outside thermostatic sensor 56 opens as the temperature drops below the preset temperature (62 F. or other desired setting).

In a like manner, thermostat 54 opens as temperatures exceed a preset temperature as determined by the end user. As the temperature of air in the enclosure or building exceeds that preset temperature, thermostat 54 opens, breaking the circuit and the fans 16 and 30 cease operation.

Under a condition of a low temperature outside the enclosure and a high temperature within the area 1', the thermostats 54 and 56 close to operate the fans when temperatures are within a pre-set range as determined by the low temperature thermostat 56. The circuits 29,29' shown in FIG. 1 reflect a typical connection joining the thermostatic assembly 22 in the enclosure, with both the interior fan at the juncture box 33, and the exterior fan, at the thermostat 56. In this manner, as a high temperature in the enclosure begins to drop, thermostat 54 closes to complete the circuit 50, 54, 56 thereby actuating both the intake fan 10 and exhaust fan 30 to initiate the circulation and forced ventilation of air from the outside, throughout the area 1' and outwardly through the louvers 3—3.

When the fans 10, 30 are operating, the wall-mounted thermostat 22 to the existing central heating/air-conditioning mechanical system 8 is disabled by means of a control relay 45.

When the inlet fan unit 10 is actuated, outside air is pulled through its housing by the fan 16 with air being pulled through the louvers 13 and filter 14. Louver grid 13 may comprise gravity type louvers which close automatically as air ceases to flow past their vaned surfaces or a mechanically controlled louver device. Air is thence directed via fan 16 through the conduit 11, to the plenum 4 for further distribution through ducts 5 and into the area 1' by way of the registers 7. The ducts 5, plenum 4 and register 7, preferable are the very same components serving the standard existing heating and air conditioning unit 8.

Exhaust air unit 30 also includes a louvered grid component 31 having louvers 31' that are normally closed but as negative air pressure is developed when fan 30 starts operation, the louvers 31' are opened and warm air is then pulled from ducts 7' which may have ceiling registers distributed in various sections of the enclosure area 1'.

The right hand portion of the control circuit of FIG. 4 depicts an alternate sub-circuit 70 operable to regulate the intake fan 16 and exhaust fan 32 and includes appropriate relays 72, 74 and switches 80, 82 respectively controlling the two fans.

By utilizing a control system substantially as disclosed herein, and a system of ducts common to a mechanical heating and cooling system, the objectives of the invention have been accomplished. Many small changes will occur to those skilled in the relevent art and therefore it is understand that the herein described disclosure is by way of example only, the limits of which reside only in the claims.

What is claimed is:

1. An apparatus for alternate modes of conditioning the air in an enclosure, comprising:

a heating and air conditioning unit having a plenum connected to a plurality of ducts discharging into the enclosure, an inlet fan having an intake communicating with the ambient air externally of said enclosure, an intake duct joining said intake to said plenum, an exhaust fan disposed in the upper reaches of said enclosure and adapted to discharge air from said enclosure to the outside thereof, first thermostatic control means operable to actuate said heating and air conditioning unit, second thermostatic control means alternately operable to simultaneously actuate both said intake and exhaust fans, said second control means including a low temperature sensor disposed exterior of said enclosure and a high temperature sensor disposed adjacent said exhaust fan, and manually operable switch means manipulatable to actuate one of said first or second control means.

2. An apparatus for alternate modes of conditioning the air in an enclosure as recited in claim 1 wherein, said inlet fan includes means for filtering said outside ambient air, and louver means overlying said inlet fan to protect said filtering means.

3. An apparatus for alternate modes of conditioning the air in an enclosure, as recited in claim 1 wherein:

said exhaust fan includes normally closed louver means for regulating passage of air from within said enclosure directly into said exhaust fan.

4. A apparatus for alternate modes of conditioning the air in an enclosure, as recited in claim 3 including, a plurality of ceiling ducts in the upper reaches of said enclosure and communicating with said exhaust fan, and said louver means disposed intermediate said ceiling ducts and exhaust fan.

* * * * *